US008082608B2

(12) United States Patent
Dabrowski

(10) Patent No.: US 8,082,608 B2
(45) Date of Patent: Dec. 27, 2011

(54) BATHING AREA SURROUND

(75) Inventor: Peter Dabrowski, Macomb, MI (US)

(73) Assignee: Masco Corporation, Taylor, MI (US)

( * ) Notice: Subject to any disclaimer, the term of this patent is extended or adjusted under 35 U.S.C. 154(b) by 1023 days.

(21) Appl. No.: 11/971,224

(22) Filed: Jan. 9, 2008

(65) Prior Publication Data

US 2009/0172875 A1 Jul. 9, 2009

(51) Int. Cl.
*A47K 3/02* (2006.01)

(52) U.S. Cl. ..... 4/584; 4/612; 4/580

(58) Field of Classification Search ..... 4/580, 584, 4/612, 670

See application file for complete search history.

(56) References Cited

U.S. PATENT DOCUMENTS

| | | | | |
|---|---|---|---|---|
| 3,827,086 | A | 8/1974 | Seymour et al. | |
| 4,316,295 | A | 2/1982 | Whitney et al. | |
| 4,423,528 | A | 1/1984 | Wiedmeier | |
| 4,578,832 | A * | 4/1986 | Primucci | 4/614 |
| 4,691,392 | A | 9/1987 | Whitney | |
| 4,901,380 | A | 2/1990 | Smith | |
| 5,671,489 | A | 9/1997 | Salach | |
| 6,691,339 | B1 | 2/2004 | Thomas | |
| 7,424,754 | B2 * | 9/2008 | Ingram et al. | 4/584 |

OTHER PUBLICATIONS

Sterling, "Installation Guide Baths and Wall Surrounds", 2004, pp. 1-16.*

Sterling, "Installation Guide Baths and Wall Surrounds", pp. 1-16.

* cited by examiner

*Primary Examiner* — Brian Glessner
*Assistant Examiner* — Patrick Maestri
(74) *Attorney, Agent, or Firm* — Carlson Gaskey & Olds, P.C.

(57) ABSTRACT

An example bathing surround includes a surround wall, a tub basin having a top tub bottom and a plurality of tub sides, and a tub ledge extending from the tub basin transverse to the tub sides. A tub flange extends from the tub ledge away from the tub bottom. The tub ledge and the surround wall defines a groove for receiving a tongue extending the other of the tub ledge and the surround wall. The surround wall is biased toward the tub flange when the tub tongue is received within the groove.

19 Claims, 4 Drawing Sheets

BATHING AREA SURROUND

BACKGROUND OF THE INVENTION

This invention relates generally to securing panels of a bathing area surround to a tub basin.

Moisture splashing or leaking from a bathing area during a bath or shower may damage adjacent areas, such as bathroom walls or floors. Bathing area surrounds protect the adjacent areas by containing moisture in the bathing area. Some bathing areas, such as tubs or showers, include bathing surround panels designed to contain moisture to a tub basin. However, such panels are often relatively large, difficult to manipulate into position, and prone to leaking at panel joints.

SUMMARY

An example bathing surround includes a surround wall, a tub basin having a top tub bottom and a plurality of tub sides, and a tub ledge extending from the tub basin transverse to the tub sides. A tub flange extends from the tub ledge away from the tub bottom. The tub ledge or the surround wall defines a groove for receiving a tongue extending from the other of the tub ledge and the surround wall. The surround wall is biased toward the tub flange when the tub tongue is received within the groove.

The example bathing area surround may include a tub basin having a tub bottom and a plurality of tub sides. A tub ledge extends from the tub basin, and a tub flange extends from the tub ledge away from the tub bottom. The surround wall includes a surround flange formed with the surround wall. The surround flange extends away from the surround wall and is supported by the tub ledge when the surround wall is in an installed position. The tub ledge or the surround flange defines a groove for receiving a tongue formed with the other of the tub ledge and the surround flange. The surround wall is biased toward the tub flange when the surround wall is in an installed position.

An example method of installing a bathing area surround includes biasing a surround away from the tub basin while moving the surround wall toward the tub basin.

BRIEF DESCRIPTION OF THE DRAWINGS

These and other features of the present invention can be best understood from the following specification and drawings, the following of which is a brief description.

DETAILED DESCRIPTION OF THE PREFERRED EMBODIMENT

Figure 1:
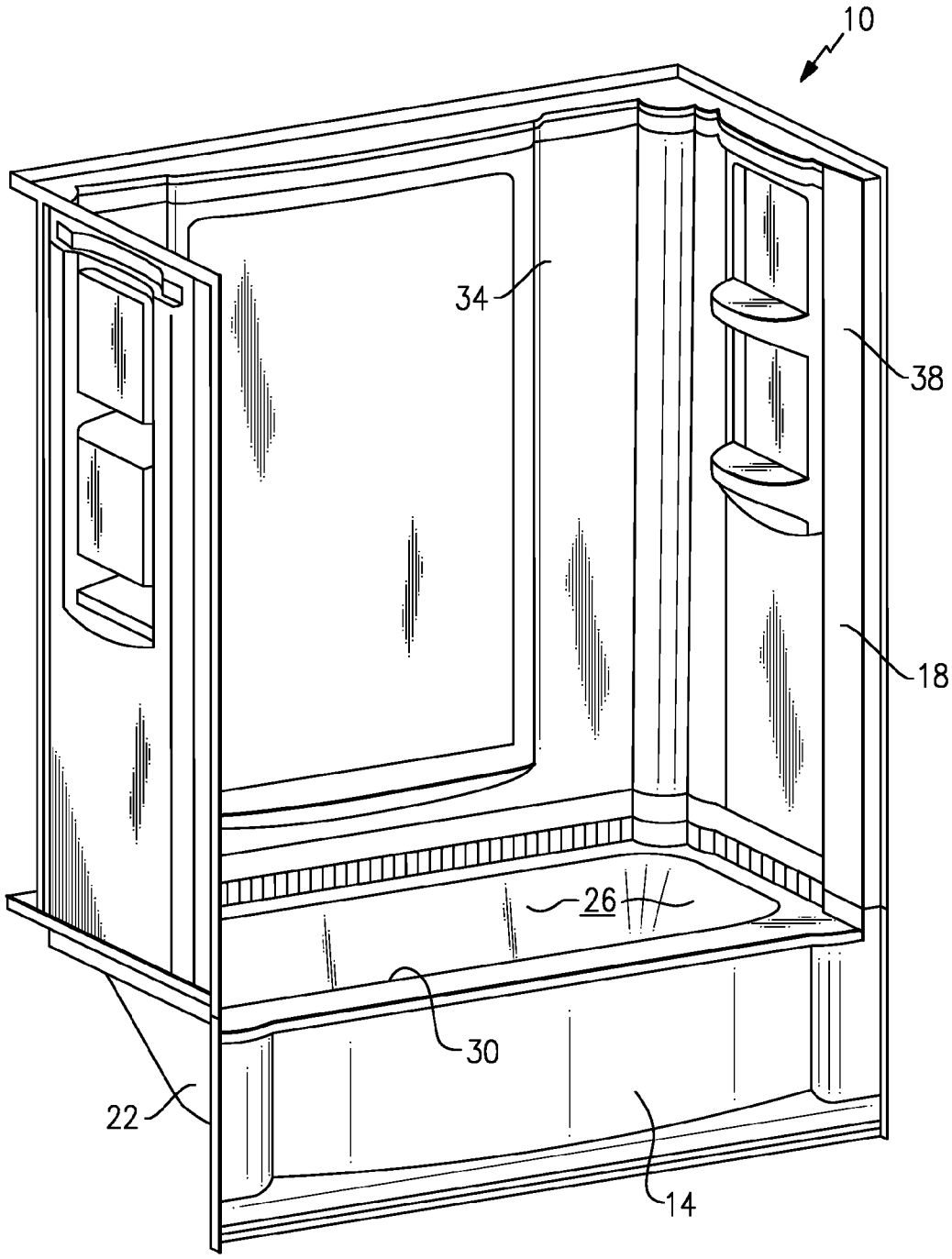
FIG. 1 illustrates a perspective view of an example bathing area surround.

FIG. 1 illustrates an example bathing area surround 10 including a tub basin 14 and a surround wall 18. The tub basin includes a tub bottom 22, tub sides 26, and a tub ledge 30. The bathing area surround 10 is shown in an installed position on the tub ledge 30. The surround wall 18 includes multiple surround wall sections, such as a surround wall back 34 and sides 38. In this example, the tub basin 14, the surround wall back 34, and the surround walls sides 38 are each separate pieces that are attached together to form the bathing area surround 10.

Figure 2:
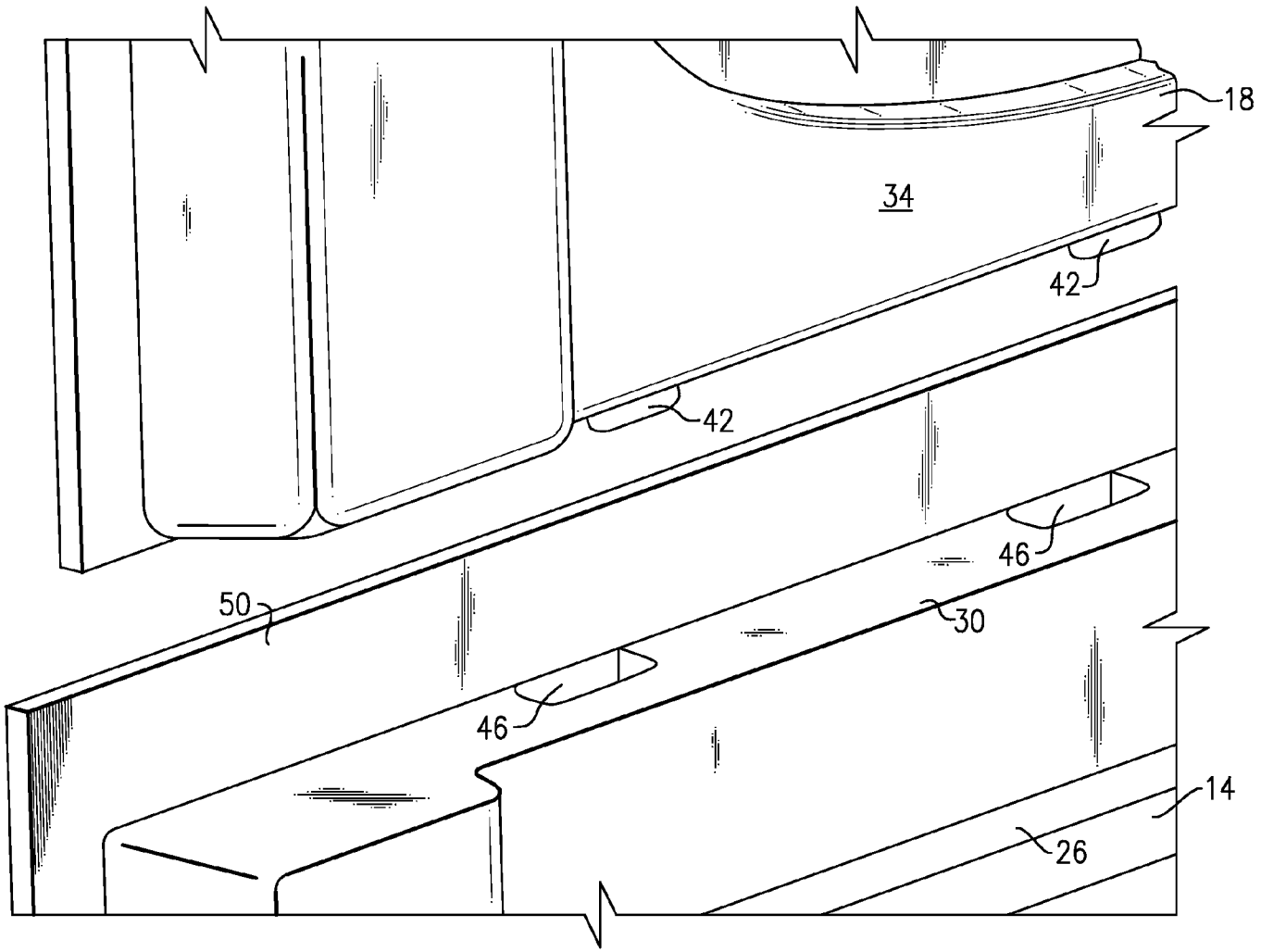
FIG. 2 illustrates a close up view of one of the surround wall sections in an installed position.

FIG. 2 illustrates the surround wall back 34 in an unassembled position. The surround wall back 34 includes a tongue 42 for receipt within a groove 46 defined by the tub ledge 30. A tub flange 50 extends from the tub ledge 30 along the rear of the surround wall back 34.

The tub basin 14 and the surround wall 18 are formed from vacuum formed polystyrene panels, for example. Vacuum forming also forms the tongue 42 and the groove 46, which secures the surround wall 18 relative the tub basin 14. Accordingly, the features for securing the surround wall 18 near the tub basin 14 can be made entirely with vacuum forming operations. In some examples, a water jet cutter shapes the perimeter of the tub basin 14 and the surround wall 18 after vacuum forming the individual panels. The water jet cutter may help shape the tongue 42 and cutouts or other details within the bathing surround 10.

Figure 3:
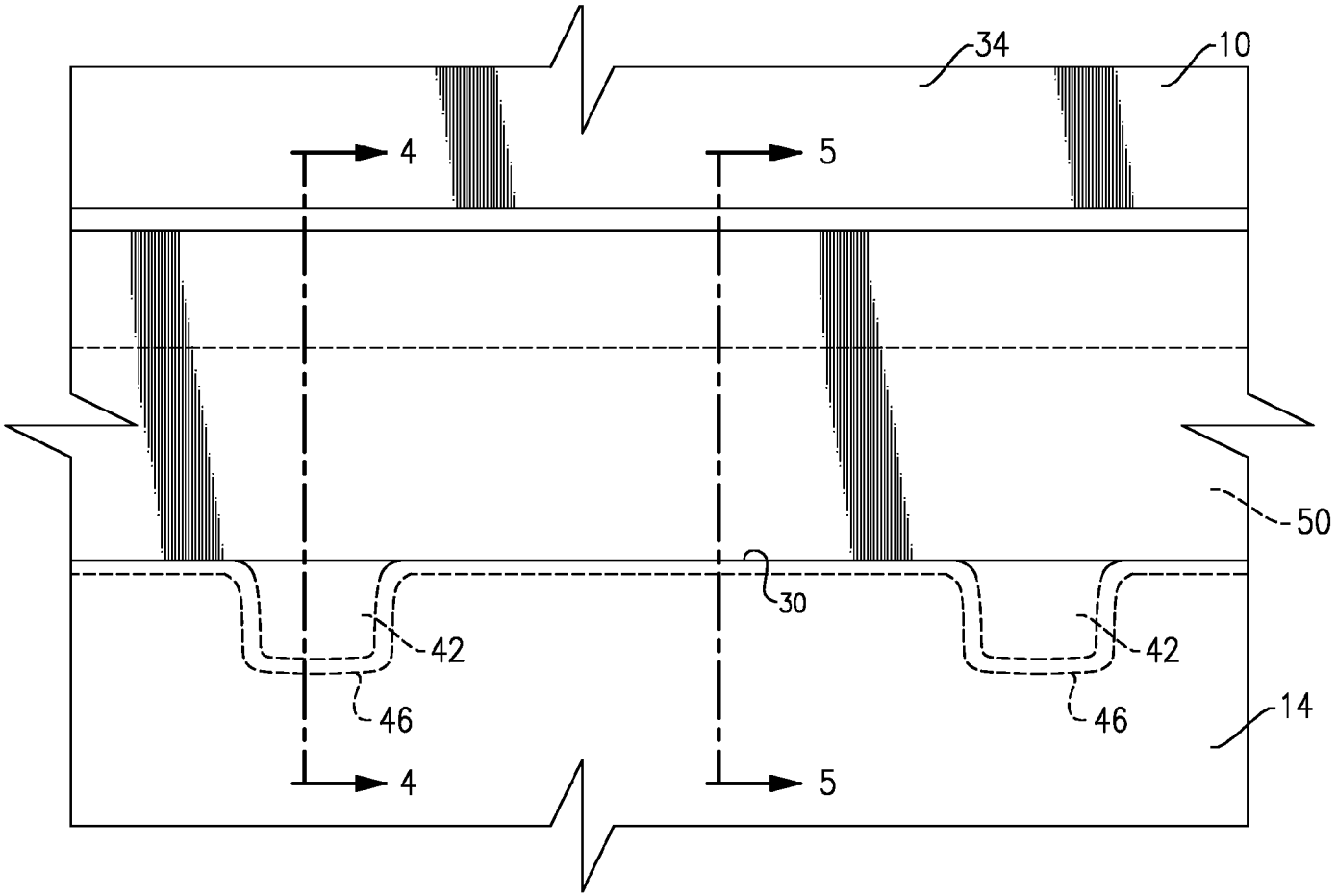
FIG. 3 illustrates a front view of the FIG. 2 section in an installed position.

Referring now to FIG. 3, in the installed position, the surround wall back 34 contacts the tub basin 14 at the tub ledge 30 when the tongue 42 is received with in the groove 46. The tongue 42 extends into the groove 46 beyond the tub ledge 30. As shown in FIG. 4A, the tongue 42 helps bias portions of the surround wall back 34 toward the tub flange 50. More specifically, moving the tongue 42 to the installed position within the groove 46 tends to move the tongue 42 away from the tub side 26 in direction X as the tongue 42 slides down a surface 52 defining a portion of the groove 46. The surface 52 angles away from the tub basin 14 to direct the tongue 42 away from the tub basin 14.

The tongue 42 also helps bias portions of the surround wall 18 against a bathroom wall 44. The tongue 42 pulls portions of the surround wall 18 toward the bathroom wall 44 as the tongue 42 moves down the surface 52. As known, the bathroom wall 44 may include studs that are covered by the surround wall 18.

Figure 4B:
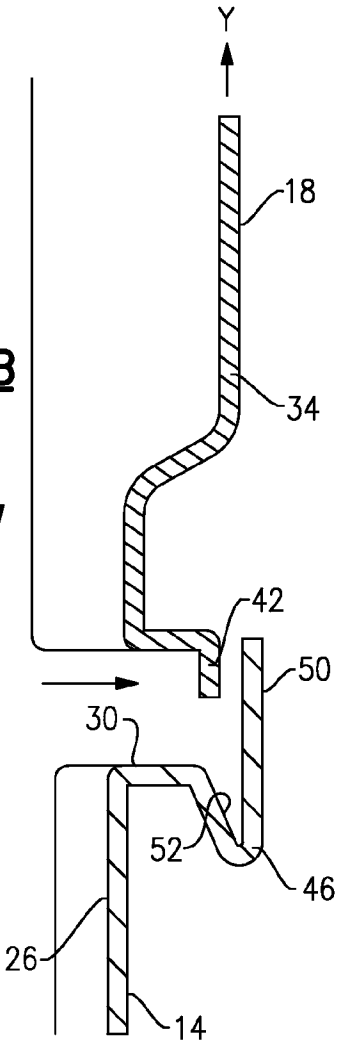
FIG. 4B illustrates a sectional view through line 4-4 FIG. 3 when the panel is in an uninstalled position.
Figure 4A:
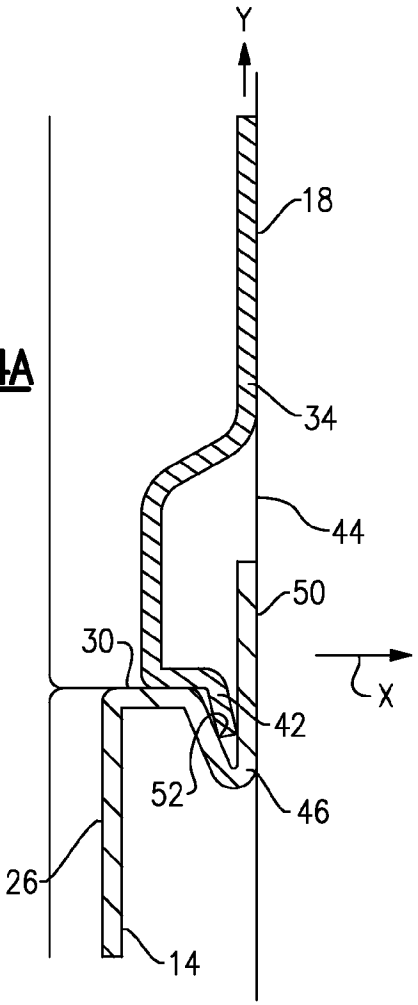
FIG. 4A illustrates a sectional view through line 4-4 of FIG. 3 when the panel is in an installed position.

FIG. 4B shows the tongue 42 prior to moving to the installed position of FIG. 4A. As shown, the tongue 42 is aligned relative an axis Y defined generally by the surround wall back 34 in an uninstalled position, but flexes away from the axis Y when moving toward an installed position. In another example, the tongue 42 is transverse the axis Y when in the uninstalled position, but moves toward the axis Y as the tongue 42 slides down the surface 52 to the installed position.

Figure 5:
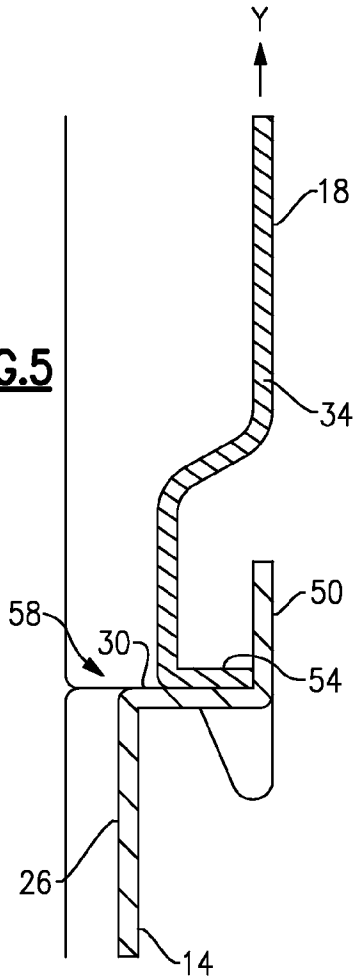
FIG. 5 illustrates a sectional view through line 5-5 of FIG. 3.

Referring now to FIG. 5, moving the tongue 42 away from the tub side 26 moves a surround flange 54 formed with the surround wall back 34 closer to the tub flange 50. Moving the surround flange 54 toward the tub flange 50 beneficially helps seal an interface 58 of the surround wall back 34 and the tub ledge 30. In some examples, an installer may run a bead of caulk along the interface 58. The installer may use mechanical fasteners, such as nails or screws, to hold the surround wall 18 position against the tub ledge 30, but generally no fasteners are needed to hold the surround flange 54 against the tub flange 50. The mechanical fasteners are also located apart from the interface 58 near the upper portions of the surround wall 18 away from the tub basin 14.

The surround wall sides 38 install to the tub ledge 30 in a similar manner. Although shown as the tongue 42 formed with the surround wall back 34, those skilled in the art and having the benefit of this disclosure will understand that other examples may include the surround wall back 34 including the groove 46 and the tongue 42 extending from the tub ledge 30.

Although a preferred embodiment of this invention has been disclosed, a worker of ordinary skill in this art would recognize that certain modifications would come within the scope of this invention. For that reason, the following claims should be studied to determine the true scope and content of this invention.

I claim:

1. A bathing area surround, comprising:

a surround wall;

a tub basin having a tub bottom and a plurality of tub sides;

a tub ledge extending from the tub basin transverse to the plurality of tub sides; and a tub flange extending from said tub ledge away from the tub bottom, wherein a tongue extends from one of said tub ledge and said surround wall, and the other of said tub ledge and said surround wall defines a groove for receiving said tongue, wherein said surround wall is biased toward said tub flange when said tongue is received within said groove wherein said tongue is moveable between an aligned position and a flexed position, said tongue in the flexed position when said tongue is received within said groove and said surround wall is in an installed position.

2. The bathing area surround of claim 1, wherein moving said tongue within said groove biases said surround wall toward said tub flange.

3. The bathing area surround of claim 1, wherein said tub ledge supports said surround wall.

4. The bathing area surround of claim 1, including a surround flange extending transversely from said surround wall.

5. The bathing area surround of claim 4, wherein said surround flange contacts said tub ledge to support said surround wall when said tongue is received within said groove.

6. The bathing area surround of claim 1, wherein said tub wall is vacuum formed.

7. The bathing area surround of claim 1, said groove is defined by a first surface angled relative to said tub flange and a second surface parallel to said tub flange.

8. The bathing area surround of claim 1, wherein said tongue is angled relative to an interior face of said surround wall when said tongue is received within said groove and said surround wall is in an installed position.

9. The bathing area surround of claim 1, wherein said tongue biases said surround wall toward an interior bathroom wall.

10. The bathing area surround of claim 1, including a second tongue extending from the other of said tub ledge and said surround wall, said second tongue separate from said tongue, and configured to be received within a second groove separate from said groove.

11. The bathing area surround of claim 1, wherein said tongue is aligned with said surround wall when in the aligned position, and said tongue is transverse to said surround wall when said tongue is in the flexed position.

12. A bathing area surround, comprising:

a tub basin having a tub bottom and a plurality of tub sides;

a tub ledge extending from the tub basin;

a tub flange extending from said tub ledge away from the tub bottom;

a surround wall; and a surround flange portion of said surround wall, said surround flange extending away from other portions of said surround wall and supported by said tub ledge when said surround wall is in an installed position, wherein one of said tub ledge and said surround flange defines a groove, and a tongue is formed with the other of said tub ledge and said surround flange, said surround wall is biased toward said tub flange when said surround wall is in an installed position wherein said tongue is a portion of said surround flange, and said tongue is moveable relative to said surround flange between an aligned position and a flexed position that is different than the aligned position, said tongue in the flexed position when said tongue is received within said groove.

13. The bathing area surround of claim 12, wherein moving said tongue within said groove biases said surround wall away from said tub flange.

14. The bathing area surround of claim 12, wherein moving said tongue against a side of said groove biases said surround wall toward said tub flange.

15. The bathing area surround of claim 12, wherein moving said tongue within said groove moves said tongue away from said tub basin.

16. The bathing area surround of claim 12, wherein said surround wall is vacuum formed.

17. The bathing area surround of claim 12, wherein said tub ledge and said surround flange are parallel to each other when said surround flange is in the installed position.

18. The bathing area surround of claim 12, wherein said groove is defined by said tub ledge, and a wall of said groove is parallel to said tub flange.

19. A bathing area surround, comprising:

a surround wall moveable between an uninstalled position and an installed position relative to a tub;

a surround flange extending outwardly from said surround wall;

a plurality of separate tongues extending downwardly from said surround flange, each of said plurality of separate tongues moveable between an unflexed position and a flexed position;

a tub bottom of said tub;

a plurality of tub sides extending upwardly from said tub bottom;

a tub ledge extending outwardly from at least some of said plurality of tub sides, said tub ledge defining a plurality of separate grooves each configured to receive a corresponding one of said plurality of separate tongues;

a tub flange extending upwardly from said tub ledge, wherein each of said plurality of separate grooves are defined by at least an outer groove wall and an inner groove wall, said outer groove wall aligned with said tub flange, said inner groove wall angled relative to said tub flange, wherein said plurality of separate tongues are each in the flexed position when said plurality of separate tongues are received within said plurality of separate grooves and said surround wall is in an installed position relative to said tub, wherein said surround flange is resting on said tub ledge and is biased toward said tub flange when said plurality of separate tongues are received within said plurality of separate grooves and said surround wall is in an installed position relative to said tub.

* * * * *